United States Patent [19]

Potts

[11] 4,224,283

[45] Sep. 23, 1980

[54] PURIFICATION OF HYDROCARBONS

[75] Inventor: Mack F. Potts, Bartlesville, Okla.

[73] Assignee: Phillips Petroleum Company, Bartlesville, Okla.

[21] Appl. No.: 16,780

[22] Filed: Mar. 2, 1979

Related U.S. Application Data

[62] Division of Ser. No. 824,125, Aug. 12, 1977, Pat. No. 4,167,531.

[51] Int. Cl.[2] ..... C10G 17/00; B01J 8/02

[52] U.S. Cl. ..... 422/111; 23/230 A; 422/115; 422/119; 422/187; 422/190; 422/188; 208/DIG. 1

[58] Field of Search ..... 422/109, 111, 115, 190, 422/187, 189, 223, 119, 188; 202/160; 203/2, 3; 585/723, 842, 854; 23/230 A, 230 PC; 208/DIG. 1

[56] References Cited

U.S. PATENT DOCUMENTS

| | | | |
|---|---|---|---|
| 2,397,224 | 3/1946 | Walsh, Jr. et al. | 585/854 |
| 2,504,464 | 4/1950 | Stanley | 203/2 |
| 3,254,713 | 5/1966 | Hatts et al. | 585/713 |
| 3,316,322 | 4/1967 | Glann | 208/DIG. 11 |
| 3,324,030 | 6/1967 | Calalrese et al. | 422/223 |
| 3,451,895 | 6/1969 | Webb | 203/2 |
| 3,547,806 | 12/1970 | Matyear | 208/47 |
| 3,759,820 | 9/1973 | Boyd | 208/DIG. 1 X |
| 4,123,351 | 10/1978 | Chapman | 585/854 |

*Primary Examiner*—Michael S. Marcus

[57] ABSTRACT

In the purification of hydrocarbon streams containing HF by chemical reaction with potassium hydroxide, a small portion of the hydrocarbon stream containing HF is passed through a small test bed of solid KOH; and when excess HF is present in the hydrocarbon stream to be purified, the temperature of the test bed increase significantly and rapidly and the flow of hydrocarbon is discontinued to the main treater responsive to the temperature in the test bed thereby preventing the treater temperature from exceeding a preselected maximum allowable value. In one embodiment, the main hydrocarbon charge is by-passed around the main KOH treater and introduced into the effluent from the treater; and in another embodiment, the hydrocarbon charge is returned to a settling zone following alkylation and prior to separation facilities utilized to process the hydrocarbon phase.

6 Claims, 6 Drawing Figures

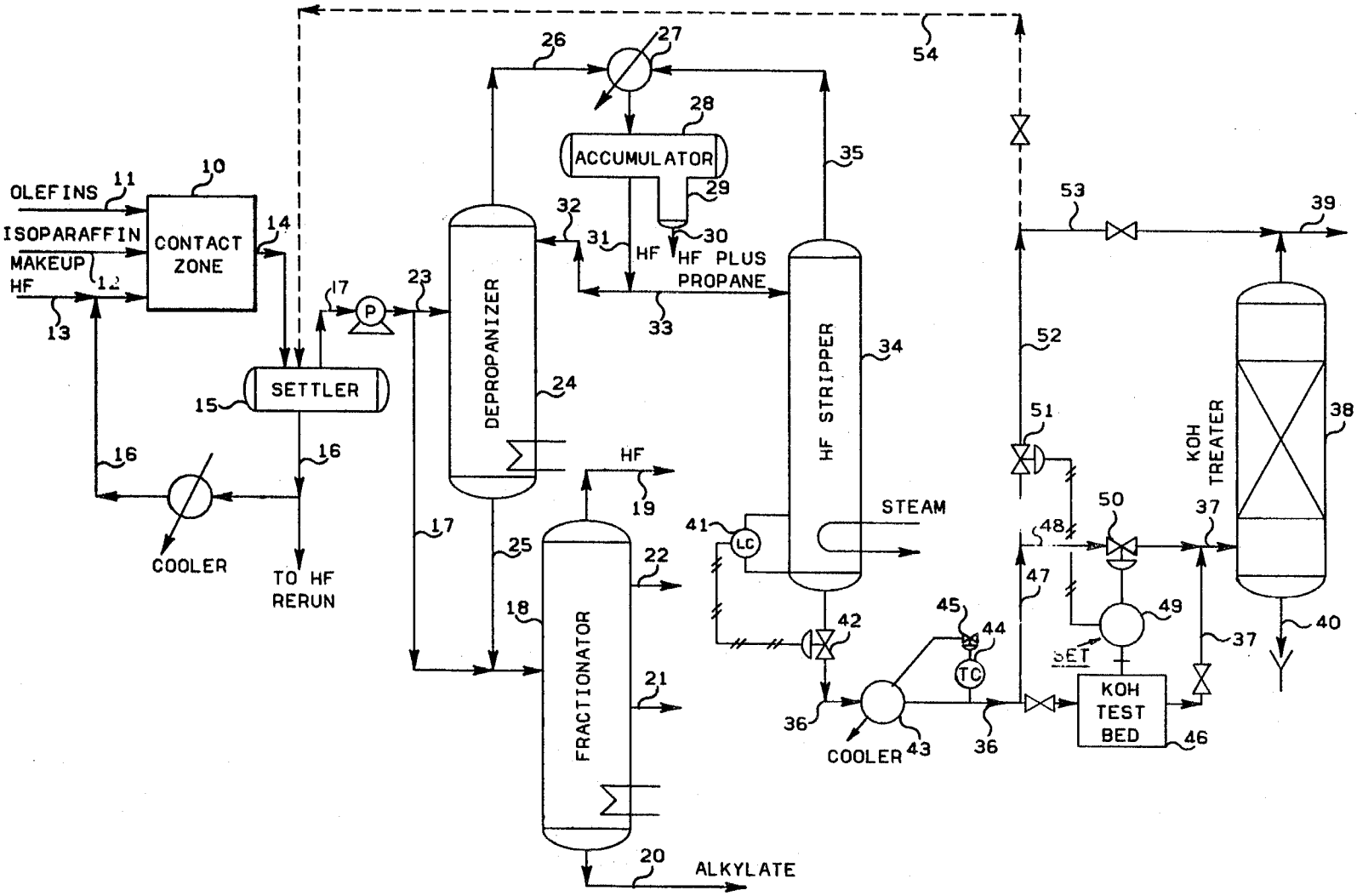
OLEFINS
ISOPARAFFIN
MAKEUP HF
CONTACT ZONE
SETTLER
TO HF RERUN
COOLER
DEPROPANIZER
ACCUMULATOR
HF PLUS PROPANE
HF
HF STRIPPER
STEAM
FRACTIONATOR
ALKYLATE
COOLER
KOH TEST BED
KOH TREATER
SET
LC
TC
P

PURIFICATION OF HYDROCARBONS

This application is a division of my copending application having Ser. No. 824,125, filed Aug. 12, 1977 now U.S. Pat. No. 4,167,531, issued Sept. 11, 1979.

This invention relates to the removal of HF from hydrocarbon streams containing same. In accordance with one aspect, this invention relates to the continuous separation of hydrofluoric acid from a hydrocarbon stream employing a solid potassium hydroxide treating agent and control of the separation whereby excessive run-away temperatures are avoided in the KOH treater. In another aspect, this invention relates to a method and apparatus for controlling purification of a hydrocarbon containing HF by contacting a portion of the hydrocarbon stream with a small test bed of solid KOH, then responsive to temperature changes in the test bed manipulating the flow of hydrocarbon to the main KOH treater wherein the flow is discontinued when excess HF is present to avoid the treater temperature from exceeding a preselected maximum allowable value.

In a process for the conversion of hydrocarbons wherein liquid hydrogen fluoride (HF) is employed as a catalyst, small amounts of HF acid and organic fluorides are present in the product streams due to the solubility of these materials in hydrocarbons. In most commercial operations, the hydrocarbon phase containing organic fluorides and HF is recontacted with relatively pure liquid HF to remove the organic fluorides therefrom, as described in U.S. Pat. No. 3,254,137, issued May 31, 1966, Hutto et al. In some operations, the propane and normal butane yields are treated with a solid reagent such as bauxite or alumina to remove organic fluorides therefrom as described in U.S. Pat. No. 3,527,840, issued Sept. 8, 1970, to Price. With substantially all of the organic fluorides removed, the propane and the normal butane separate yields can be treated with solid KOH to remove the remaining HF, as described in the above Hutto et al patent. When organic fluorides are not first removed, as above described, then the propane and normal butane yields are each separately treated with solid KOH in the presence of added alcohol, as described in U.S. Pat. No. 3,403,198, issued Sept. 24, 1968, to Van Pool. This organic fluoride removal, using bauxite or alumina, is effected between the HF stripper and the solid lump KOH treater. KOH removes substantially only HF from the hydrocarbon.

It is necessary to remove HF from these streams before subsequent processing or blending of the hydrocarbon streams. Normally, the amount of HF present in the hydrocarbon stream is relatively small but the HF still has to be removed from the hydrocarbon streams in order that the hydrocarbons will pass the fluoride specification for the respective streams. Residual amounts of HF are ordinarily removed by contact with solid KOH. Upsets often occur in the processing equipment thereby causing excess Hf in the stream to be charged to the solid bed of KOH particles. When too much HF contacts the KOH, the temperature starts to rise in the bed area due to the heat of reaction between KOH and HF. If excess HF is allowed to continue to flow to the KOH treater, runaway temperatures are experienced which can cause hydrocarbons charged to vaporize and "blow up" the KOH treater with danger then of fires, etc. The present invention is directed to an improved system of controlling the flow of hydrocarbon streams containing HF to a KOH treater in order to prevent runaway temperatures and subsequent explosions.

Accordingly, an object of this invention is to provide an improved method and control system for the removal of HF from hydrocarbon streams.

A further object of this invention is to provide a temperature-sensitive control system for regulating the flow of hydrocarbon streams containing HF to a treater in a practical and economical manner.

A further object of this invention is to provide a sensitive and rapid response control system and method for the purification of hydrocarbon streams.

Other objects, aspects, and the several advantages of the invention will be apparent to those skilled in the art upon a study of this disclosure, the drawing, and appended claims.

In accordance with the invention, a method and a control system are provided for manipulating the flow of hydrocarbon containing HF to a KOH treater whereby the flow of hydrocarbon is regulated responsive to temperature changes in the separation system in a manner such that the temperature in the KOH treater does not exceed a preselected maximum allowable value.

In accordance with one embodiment, a small stream of hydrocarbon containing HF is passed through a small test bed of solid KOH located upstream of the main KOH treater; the flow of hydrocarbon containing HF to the main KOH treater is manipulated in response to a preselected maximum allowable temperature in the small test bed of solid KOH whereby a by-pass valve is opened and the main KOH charge line is closed when the temperature in the test bed of KOH reaches a preselected maximum value.

In accordance with another embodiment, a stripped stream of liquid propane removed from the upper portion of an alkylation HF stripper is passed through a small test bed of solid KOH upstream of the main KOH treater and when excess HF is present in the stripped stream the temperature in the test bed rises rapidly and in response to changes in the temperature in the test bed the flow of propane is manipulated whereby the propane is passed through a by-pass line rather than be introduced into the main KOH treater in order to prevent runaway temperatures and explosions within the treater.

A better understanding of the invention will be obtained upon reference to the accompanying drawing, which is a schematic flow diagram of an alkylation process utilizing one embodiment of the invention.

Referring to the drawing, an alkylation system is illustrated comprising a reactor or contact zone 10 having inlet conduits 11 for olefin such as propylene and/or butylenes, 12 for isoparaffin such as isobutane, and 13 for rerun and makeup hydrogen fluoride (HF) catalyst. Effluent from contact zone 10 is removed via conduit 14 and passed to phase separator or settler 15 wherein the HF phase settles and is removed for recycle via conduit 16 to contact zone 10, with a portion being passed to a rerun system (not shown) for removal of impurities.

The hydrocarbon phase is removed from separation zone 15 by way of line 17 and passed to fractionation zone 18, which can be a plurality of distillation columns, wherein HF is removed by line 19; alkylate is removed by line 20; normal butane (vapor) is removed by line 21; and isobutane is removed by way of line 22 and recycled (not shown) to contact zone 10.

Propane is often present in the propylene feed, with fresh isobutane feed, and some propane is produced in the process. In order to prevent a buildup of propane in the system, a portion of the stream (sufficient to prevent propane buildup in recycle isobutane 22) is passed from conduit 17 by way of line 23 to depropanizer 24. Isobutane and higher boiling bottoms are passed by way of line 25 to conduit 17 and then to fractionator 18. Overhead product comprising propane, HF, and alkyl fluorides, when present, is passed by way of line 26 and condenser 27 to phase separator 28. Liquid HF accumulates in sump or leg 29 and is withdrawn by way of line 30. Hydrocarbon liquid, principally propane, containing dissolved HF and alkyl fluoride, e.g., isopropyl fluoride, when present, is withdrawn by way of line 31. A portion of the condensate in 28 is passed by way of line 32 as reflux to depropanizer 24.

The yield portion of the hydrocarbon liquid removed from settler 28 by line 31 is passed by way of line 33 to HF stripper 34 for removal of HF. Overhead product comprising HF and propane passes via conduit 35 and condenser 27 back to phase separator or accumulator 28. Bottoms product comprising propane and a small or trace amount of HF and, if not previously removed, containing alkyl fluorides (in which case there is a treatment thereof with such as bauxite or alumina upstream, not shown, of the KOH treater), is passed by way of conduits 36 and 37 to contact vessel 38 containing a bed of solid KOH. Propane of very substantially reduced fluoride content is removed as product by way of line 39. A slurry of water and KOH-HF reaction products (slough) is removed from KOH treater 38 by way of line 40 for disposal of or recovery of KOH. The propane product stream removed overhead from treater 38 by way of line 39 is substantially dry and free of fluorides.

The rate of withdrawal of bottoms product (which has been heated indirectly with steam) removed from the lower portion of stripper 34 by way of line 36 is controlled responsive to the liquid level in the lower portion of stripper 34. Liquid level controller 41 manipulates the position of valve 42 in accordance with the desired level of liquid in the bottom of stripper 34. The temperature of the bottoms stream removed from stripper 34 in line 36 is usually somewhat higher than desired for contact with KOH in treater 38, and, accordingly, is cooled in heat exchanger 43 to a temperature of about 100° F. (37.8° C.). The flow of heat exchange fluid through heat exchanger 43 is controlled by temperature controller 44 which regulates the position of valve 45 responsive to the temperature sensed in line 36 downstream of heat exchanger 43.

The partially cooled liquid hydrocarbon stream 36 is in part passed through a small test bed of KOH in vessel 46, and the remainder which is substantially a major portion of the liquid hydrocarbon stream is passed around the test bed 46 by way of line 47 and valved line 48 for introduction into KOH treater 38 by way of line 37. The temperature in test bed 46 is sensed by temperature controller 49 which is operatively connected to valve 50 and valve 51. Temperature controller 49 is set at a maximum allowable temperature for KOH bed 46 which temperature should not be exceeded to avoid runaway bed temperatures and possible explosions in either the best bed 46 or KOH treater 38. If the temperature in bed 46 reaches or exceeds the set temperature for temperature controller 49, temperature controller 49 will then actuate valves 50 and 51. Valve 50 is normally open and valve 51 is normally closed. However, during upset of the unit when excess HF is present and the temperature in test bed 46 exceeds the maximum allowable temperature, temperature controller 49 is actuated and in turn regulates the flow of hydrocarbon in line 47 by closing valve 50 and opening valve 51. The stream being by-passed can be sent through either line 52 and valved line 53 and line 49, or passed through valved line 54 for return to settler 15.

In actual operation, the liquid hydrocarbon stream containing residual HF is normally charged to the KOH treater 38 by way of line 37 at a temperature of about 100° F. (37.8° C.), and the stream contains a small amount of HF insufficient to cause significant increases of the temperature in KOH test bed 46. There is a slight warming in KOH test bed 46 when the normally small amount of HF, say, 10 to 50 ppm, is present in the charge introduced by line 36. When upset occurs with excess HF, as slugs of free HF, or, e.g., at least about several hundred ppm, flowing in or with the liquid feed to test bed 46 and treater 38, the KOH bed 46 temperature starts to increase rapidly. Temperature control means 49 which senses the temperature in KOH bed 46 is set for about 120°-130° F. (49°-54° C.). Thus, when 130° F. (54° C.) is reached, valve 50 which is normally open is closed and valve 51 which is normally closed is opened to allow the high HF-containing stream to be by-passed around treater 38 by way of lines 47, 52, and 53 or 54. If desired, an alarm can be sounded, say, at 120°-125° F. (49°-51.78° C.), and valves 50 and 51 can be manipulated as above between 125°-130° F. (51.78°-54° C.). These valves 50 and 51 are opposite acting; that is, one opens as the other closes. The valves in conduits 53 and 54 can be hand-operated with, normally, the valve in 53 being open and the valve in 54 being closed. During upset, the valve in 54 can be opened and the valve in 53 closed, or both valves in 53 and in 54 can be open.

The liquid propane (at about its bubble point) removed from the bottom of stripper 34 is at about 140° F. (60° C.) and a pressure of 285 psig (1,970 kPa gauge). The pressure in KOH treater 38 is a few pounds lower than in stripper 34, but at 100° F. (37.8° C.) inlet temperature of the propane is below its bubble point. In order to prevent vaporization of propane in the KOH unit, the maximum temperature (to stop "flashing of liquid to vapor" and resulting disaster) is set at about 125°-130° F. (51.78°-54° C.) on temperature control means 49 so that only liquid will be in treater 38.

Stripper 34 is operated under conditions sufficient to take overhead most of the HF present in the feed together with some propane and as bottoms a propane stream substantially freed of HF. Stripper 34 can be heated indirectly by steam or other heating medium in a lower portion of the stripper, preferably by indirect heat exchange. In actual operation, for the stripping of HF from a propane stream, the temperature in the upper portion of stripper 34 is ordinarily in the range of about 105° F. to about 140° F. (40°-60° C.), and the bottom temperature is ordinarily about 120° F. to about 155° F. (49°-68° C.). The pressure existing in stripper 34 is ordinarily about 250 psig (1,725 kPa g.) to about 350 psig (2,415 kPa g.).

The fractionation system disclosed in the drawing uses a separate main column 18, along with the depropanizer 34-HF stripper 38 columns. Other conventional fractionation can be used upstream of the HF stripper, e.g., for example, as disclosed in U.S. Pat. No. 3,211,802, issued Oct. 12, 1965, to Dixon et al.

I claim:

1. An apparatus for controlling the separation of HF from hydrocarbons in a manner such that excessive temperature increases above a preselected maximum allowable temperature due to unexpected excess HF are avoided which apparatus comprises, in combination:

a stripping column having an inlet means for introducing feed into an intermediate portion of the column, an overhead outlet for removing materials stripped from the feed, and a bottom outlet for removing stripped feed containing residual amounts of HF, a vessel means containing solid KOH and having an inlet for introduction of stripped feed removed from the bottom outlet of said stripping column, an overhead outlet for removing KOH-treated feed, and a bottoms outlet for removing sludge, a test vessel means containing solid KOH used as a test bed having an inlet for introduction of stripped feed removed from the bottom outlet of said stripping column, and an outlet for removing a small stream of KOH-treated feed, a first conduit means for connecting said bottoms outlet of said stripping column with the feed inlet of said test vessel means containing said test bed of KOH, a second conduit means connecting the outlet of said test vessel means and said inlet for introduction of stripped feed into said vessel means, a third conduit means connecting said first conduit means and said second conduit means and by-passing said test vessel means containing said test bed of KOH, by-pass conduit means connected to said third conduit means, a first flow control valve in said third conduit means and a second flow control valve in said by-pass conduit means, said first and said second flow control valves being positioned downstream of the junction point of said by-pass conduit means and said third conduit means, and a temperature-sensing means in said test vessel means connecting said first and said second control valves which are manipulated in response to a preselected maximum allowable temperature within said test vessel means and when this temperature reaches a preselected maximum value said second flow control valve is opened and said first flow control valve is closed.

2. An apparatus according to claim 1 which additionally contains:

heat exchange means in said first conduit means for cooling stripped feed removed from the bottom outlet of said stripping column, liquid level means for controlling the rate of flow of withdrawal of stripped feed from the bottom outlet of said stripping column responsive to the liquid level in a lower portion of said stripping column, and controlling the temperature of said stripped feed removed from said heat exchange means responsive to a preselected temperature downstream of said heat exchange means by regulating the flow of heat exchange medium through said heat exchange means.

3. An apparatus according to claim 2 wherein said by-pass conduit means is connected to said vessel overhead outlet.

4. An apparatus for controlling the separation of HF from hydrocarbons in a manner such that excessive temperature increases above a preselected maximum allowable temperature due to unexpected excess HF are avoided which apparatus comprises, in combination:

a vessel means containing solid KOH and having an inlet for introduction of hydrocarbon feed containing HF, an overhead outlet for removing KOH-treated feed, and a bottoms outlet for removing sludge, a test vessel means containing solid KOH used as a test bed having an inlet for introduction of a small stream of said feed and an outlet for removing said small stream of KOH-treated feed, a first conduit means for introducing said small stream into the inlet of said test vessel means containing said test bed of KOH, a second conduit means connecting the outlet of said test vessel means and said inlet for introduction of stripped feed into said vessel means, a third conduit means connecting said first conduit means and said second conduit means and by-passing said test vessel means of test bed of KOH, by-pass conduit means connected to said third conduit means, a first flow control valve in said third conduit means and a second flow control valve in said by-pass conduit means, said first and said second flow control valves being positioned downstream of the junction point of said by-pass conduit means and said third conduit means, and a temperature-sensing means in said test vessel means connecting said first and said second control valves which are manipulated in response to a preselected maximum allowable temperature within said test vessel means and when this temperature reaches a preselected maximum value said second flow control valve is opened and said first flow control valve is closed.

5. An apparatus according to claim 4 which additionally contains:

heat exchange means in said first conduit means for cooling said hydrocarbon feed containing HF, controlling the rate of flow of said hydrocarbon feed introduced into said heat exchange means, and controlling the temperature of said hydrocarbon feed removed from said heat exchange means responsive to a preselected temperature downstream of said heat exchange means by regulating the flow of heat exchange medium through said heat exchange means.

6. An apparatus according to claim 5 wherein said by-pass conduit means is connected to said vessel means overhead outlet.

* * * * *